US005479014A

United States Patent [19]

Francois

[11] Patent Number: 5,479,014

[45] Date of Patent: Dec. 26, 1995

[54] APPARATUS FOR CLEANING A STRIP OF UNEXPOSED PHOTOSENSITIVE PRODUCT

[75] Inventor: Bernard G. Francois, Champforgeuil, France

[73] Assignee: Eastman Kodak Company, Rochester, N.Y.

[21] Appl. No.: 162,055

[22] PCT Filed: Apr. 15, 1993

[86] PCT No.: PCT/EP93/00907

§ 371 Date: Jan. 31, 1994

§ 102(e) Date: Jan. 31, 1994

[87] PCT Pub. No.: WO93/21747

PCT Pub. Date: Oct. 28, 1993

[30] Foreign Application Priority Data

Apr. 17, 1992 [FR] France ..... 92 05195

[51] Int. Cl.[6] ..... H05F 3/04

[52] U.S. Cl. ..... 250/324; 15/1.51; 361/213; 361/214

[58] Field of Search ..... 250/324; 15/1.51; 361/213, 214

[56] References Cited

U.S. PATENT DOCUMENTS

| | | | |
|---|---|---|---|
| 3,156,847 | 11/1964 | Schweriner | 317/4 |
| 3,409,768 | 11/1968 | Whitmore et al. | 250/49.5 |
| 3,660,656 | 5/1972 | Frank et al. | 250/49.5 ZC |
| 3,675,096 | 7/1972 | Kiess | 317/262 A |
| 4,194,232 | 3/1980 | Cumming et al. | 361/213 |
| 4,241,377 | 12/1980 | Cumming | 361/213 |
| 4,417,293 | 11/1983 | Larigaldie | 361/212 |
| 4,750,080 | 6/1988 | Cumming et al. | 361/213 |

FOREIGN PATENT DOCUMENTS

| | | | |
|---|---|---|---|
| 538308 | 6/1955 | Belgium | 361/213 |
| 2528833 | 12/1976 | Germany | H05F 3/04 |
| 3942422A1 | 6/1991 | Germany | H05F 3/04 |
| 2067357 | 7/1981 | United Kingdom | H01T 19/04 |

*Primary Examiner*—Jack I. Berman
*Attorney, Agent, or Firm*—Susan L. Parulski

[57] ABSTRACT

Cleaning of a product in strip or sheet form.

The device is characterised in that:

the electrode is enclosed in an insulating housing (20) connected to the said channel by an antihalo duct (30), the housing is swept by a weak flow of air, so as to carry away the ions on the moving strip.

Application to unexposed photosensitive products.

8 Claims, 3 Drawing Sheets

Fig_3
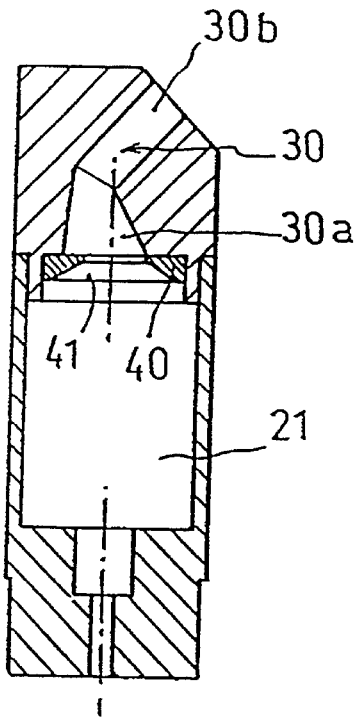
Fig_4
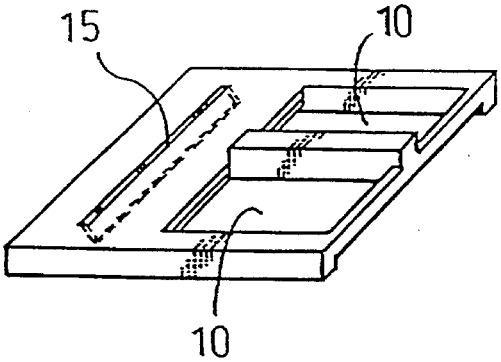
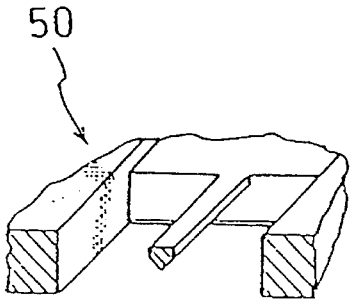
Fig_5

APPARATUS FOR CLEANING A STRIP OF UNEXPOSED PHOTOSENSITIVE PRODUCT

The present invention relates to the cleaning of products in sheet, strip or film form and concerns in particular the cleaning of or removal of dust from strips of unexposed photosensitive product which have to be packaged, after manufacture, in any appropriate form suitable for the subsequent direct use.

The industrial production of strips of unexposed photosensitive product long ago encountered the problem of the elimination of manufacturing waste, such as perforation particles and dust which adhere to the faces of the product in strip form, usually by electrostatic effect.

The presence of such dust or particles must be considered to be incompatible with obtaining a product of reproducible good high quality, since such particles of dust are responsible for damage to the product by mechanical effect or impairment of the image by electrochemical action.

With a view to dealing with the above problem, the prior art reveals a number of proposed solutions such as the one provided by U.S. Pat. No. 4,469,275 which teaches that an endless strip should be caused to follow a curved path so as to apply, to one of its convex faces, an air jet, curtain, wave or flow blowing in the opposite direction to movement of the strip. Such a solution does not appear to resolve completely the problem posed, because of the local treatment on only one face of the product and problems of pressure equilibrium on each side of the film which has to be regulated in order to avoid vibration of the film.

U.S. Pat. No. 4,194,232 teaches a method of simultaneous treatment of the two faces of the film which is also subjected to a flow of ions. U.S. Pat. No. 4,454,621, U.S. Pat. No. 4,241,377 and U.S. Pat. No. 4,750,080 can also be cited. Although in principle the solution taught by these patents may be considered suitable for assuming the function of cleaning and dust removal, the ionisation means are not compatible with the cleaning of a strip of unexposed photosensitive product. In fact, the functioning of an ion emitting device produces a glow emitted by corona effect and such a glow is responsible for the formation of latent images on the strip of unexposed photosensitive product. The quality of the basic product which was to be suitably cleaned is thus greatly impaired, to an unacceptable extent.

U.S. Pat. No. 3,409,768 describes an apparatus for treating the surfaces of a web of photosensitive material, and more particularly to an apparatus which generates a flow of ionized gas that is applied to a surface of the material for altering or neutralizing any electrostatic charge thereon and for removing any particulate matter therefrom, the apparatus including a corona discharge means and means for shielding the surface of the material from any irradiation generated by the corona discharge means.

The purpose of the invention is to remedy the above drawbacks by proposing improvements to an apparatus for cleaning an unexposed photosensitive product. Specifically, in addition to means for blowing and suction by air curtain or air wave, means of ionising the dust and particles are provided so as to assist the separation of the latter and their take-up by the flow of suction or cleaning air, without the production of the ionisation field leading to any impairment of the coating or sensitive layer on the unexposed photosensitive product.

To achieve this purpose, the cleaning apparatus of the invention is of the type including a channel through which the strip can run in one direction of movement; a treatment area established transversely to the direction of running of the strip and over the entire width of the strip, the treatment area including means for sweeping both surfaces of the strip with a curtain of air flowing in the opposite direction to the strip; and at least one electrode connected to a high potential and intended to produce local ionisation by corona effect, characterised in that the electrode is enclosed in an insulating housing connected to the said channel by an antihalo duct, the housing is swept by a light flow of air, so as to carry away ions on the moving strip.

Various other characteristics are clear from the description given below with reference to the accompanying drawings which show, by way of non-limitative example, one embodiment of the subject of the invention.

FIGS. 2 and 3 are partial sectional views in elevation showing, to a larger scale, certain details of construction of the apparatus of the invention, FIG. 3 being taken along the line III—III in FIG. 2.

FIGS. 4 and 5 are sectional perspectives showing, in more detail and to a different scale, some of the means according to the invention.

Figure 1:
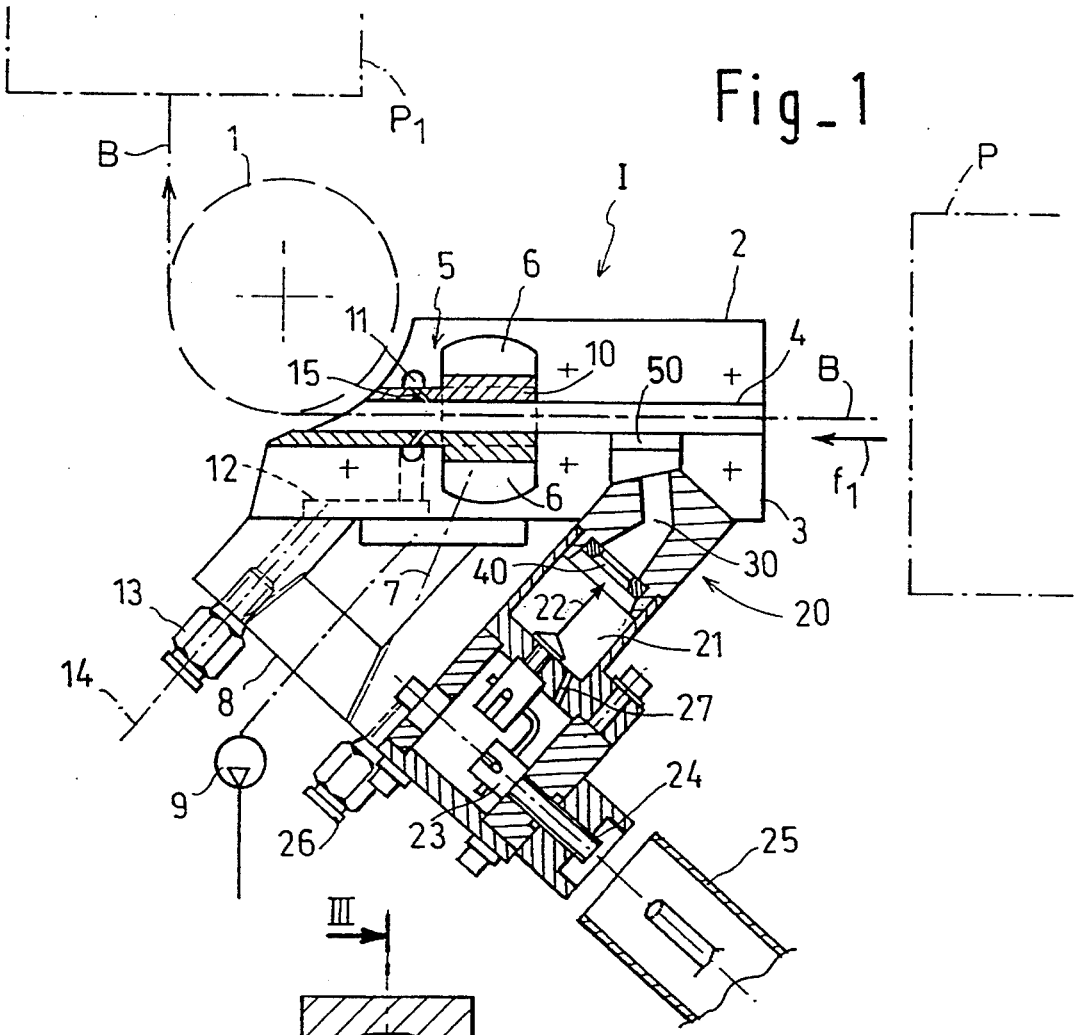
FIG. 1 is a sectional view in elevation of an apparatus according to the invention.

In the example embodiment illustrated by FIG. 1, the apparatus according to the invention, designated overall by the reference I, is designed to be positioned in the running path of a strip B of unexposed photosensitive product running, for example, in the direction of the arrow f1, between a production station P and a subsequent station P1, in particular a preliminary packaging station. The strip of product can be driven in the direction of the arrow f1, by means of the stations P, P1, or again, for example, by a capstan 1 assuming, simultaneously, the function of taking up and returning. All these components must be considered to form part of the known art.

The device I is, preferably, interposed between the station P and the capstan 1 and comprises, principally, two platens 2 and 3 which define between them a channel 4 through which the strip B runs in the direction of the arrow f1. The channel 4 has a treatment area 5 extending transversely in the direction of running of the strip B and over the entire width of the strip. The area comprises, principally, on each side of the plane of movement of the strip B, inside the running channel 4, two chambers 6, referred to as suction chambers, formed by the platens 2 and 3 and which are connected by ducts 7 to at least one duct 8 to which is connected a suction pump 9 capable of maintaining a relative negative pressure of the order of 0.3 bars. The chambers 6 are connected to the running channel 4, through openings or similar 10, more particularly shown in FIG. 4.

The treatment area 5 comprises, in addition, parallel to the chambers 6 and downstream of the latter with respect to the direction of movement according to the arrow f1, two recesses 11 which are provided in the platens 2 and 3 and which are connected, by ducts 12, to a fitting 13 to which is connected an inlet 14 for filtered compressed air capable of delivering a constant positive relative pressure of compressed air of the order of 1 bar.

The recesses 11 communicate, through openings 15, with the interior of the channel 4. The openings 15 are provided in planes such that the circulation between them and the chamber 6 induces a direction of flow of two waves or flows of air situated on each side of the strip B and moving in the opposite direction to the arrow f1.

The device described above is supplemented by an ionisation housing 20 attached, in particular, to one of the platens, such as the platen 3. The ionisation housing 20 comprises a chamber 21 defined by an electrically insulating material and supporting, internally, at least one electrode 22 connected, through one or more connectors 23, to a socket 24 for connecting to a conductor 25 for supplying high voltage electrical energy.

Figure 2:
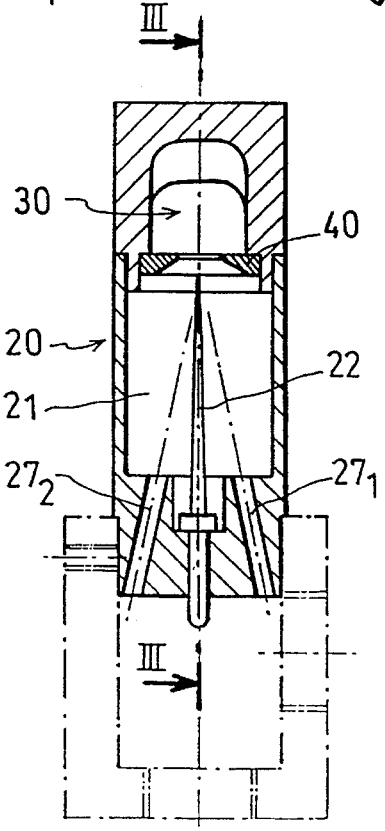

The chamber 21 is connected to a system 26 for supplying compressed air at a low relative pressure, but which is nevertheless greater than ambient atmosphere, for example of the order of 0.5 bars. The fitting 26 is arranged to deliver an air flow to the inside of the chamber 21, through at least one duct 27 which is provided in the bottom of the housing so as to have, preferably, an orientation or rectilinear axis converging towards the end of the electrode 22. Preferably, as is clear from FIG. 2, the bottom of the housing includes two holes or ducts 271, 272 which both converge towards the tip of the electrode 22.

According to another feature of the invention, the ionisation chamber 21 is connected to the running channel 4 by an antihalo duct 30 which is angled in shape, comprising a first part 30*a* connected to the chamber 21 and a second part 30*b* opening out into the running channel 4. The first part 30*a* is in the form of a converging part established between the chamber 21 and the second part 30*b*. The angled shape of the antihalo conduit 30 results, for example, from the connection between the convergent part 30*a* and the second part 30*b*.

According to another feature of the invention, the part 30*a* of the antihalo conduit is connected to the chamber 21 by a capacitor component 40 whose function is to limit the area in which the corona effect is produced when the electrode 22 is energised. The capacitor 40 consists of a component which is electrically conductive but electrically insulated, and which is disposed in the interface area between the tip of the electrode 22 and the large base of the convergent part 30*a*.

Preferably, the component 40 is constructed in an annular shape, for example as a bronze ring assuming the function of a conical diaphragm defined by a milling cut 41 made from the face of the washer 40 oriented towards the inside of the chamber 21, as is more particularly clear from FIG. 3. As illustrated, the washer 40 is coaxial with the electrode 22.

Figure 6:
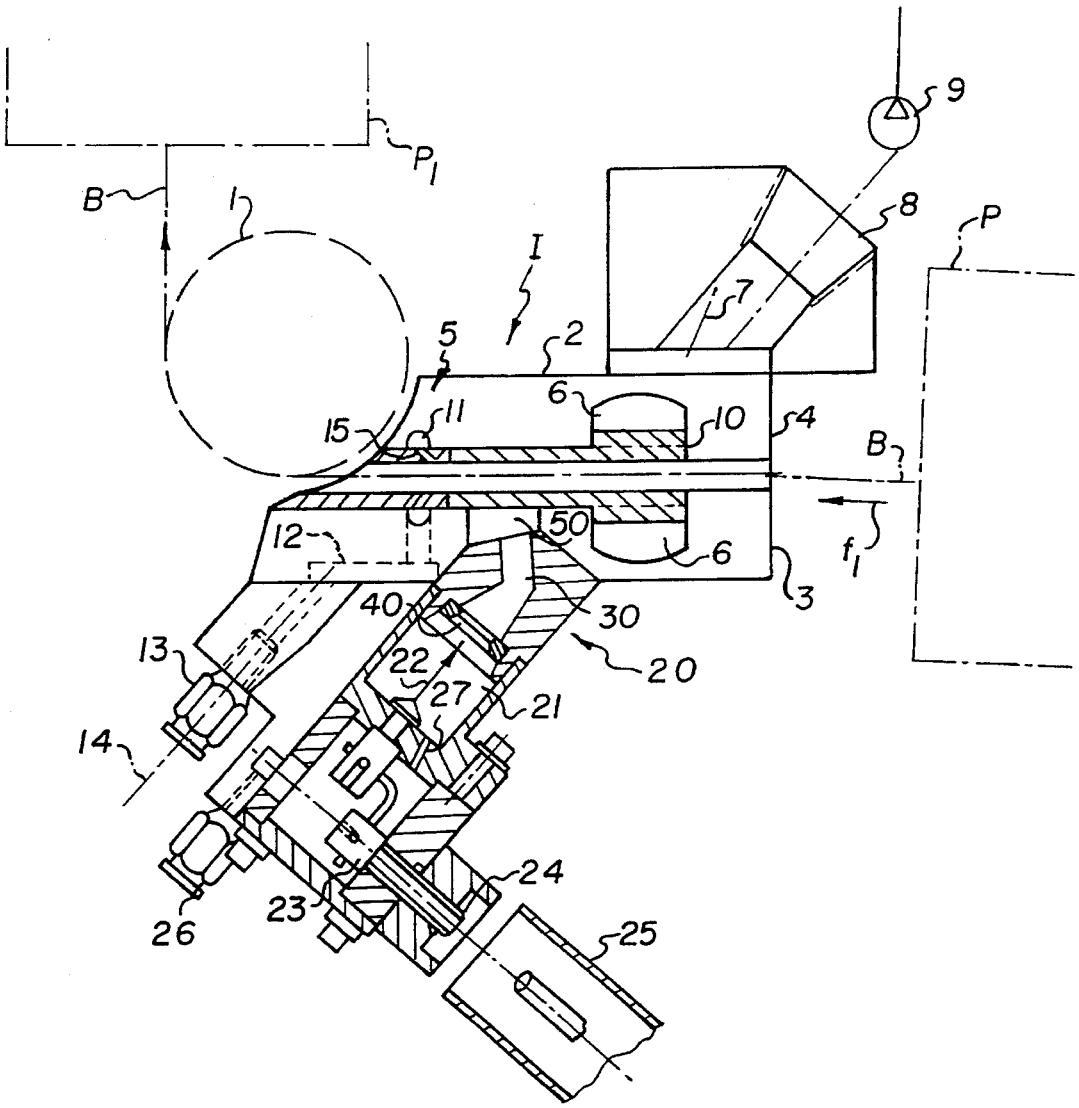
FIG. 6 is a sectional view in elevation of another embodiment according to the invention.

According to another feature of the invention, the antihalo duct 30 opens out inside the running channel 4 and over the entire length of the latter through a means 50, such as the one shown in FIG. 5 which, preferably, opens out into the said channel upstream of the chambers 6. It should be borne in mind that the means 50 can also open out into a channel 4 between the chambers 6 and recesses 11 as represented in FIG. 6

The apparatus of the invention functions as follows. Starting the device consists of establishing the flows at a positive relative pressure, through the inlet 14 and fitting 26, and at negative relative pressure, through the functioning of the pump 9. At the same time, the electrode 22 is energised so as to produce, by corona effect, an ionisation of the flow of air flowing from the chamber 21 towards the running channel 4.

The internal shape of the washer 40, and the positioning of the latter between the chamber 21 and the duct 30, have the effect of capturing the ions moved by the flow of air, in order to assume the function of capacitor with the electrode 22 so as to limit locally the area in which the corona effect occurs. Because of the presence of the angled duct 30, the glow emitted by the corona effect is trapped inside the housing 21, without being transmitted to the inside of the running channel 4, so as to avoid any formation of a latent image on the emulsion on the photosensitive product running through.

The convergent shape of the first part 30*a* channels the flow of ionised air towards the opening 50, whose function is to ensure dispersal and distribution of the flow of ionised air over the greatest surface possible of the film to be cleaned. The ions conveyed by the air flow destabilise the dust and particles attached to the strip product by static electricity, on both faces at the same time of the photosensitive strip, although the distribution of the ionised air flow is established on only one of the faces.

In fact, the static electricity characteristics carried by the second face of the photosensitive product strip are sufficiently disturbed by influence, to the point of allowing the detachment or shedding of the dust or particles which are then particularly sensitive to the mechanical shedding effect sustained in the treatment area 5 where the reverse air flow, provided by the openings 15, detaches the particles in line-with the chambers 6 where the suction produces a negative relative pressure assisting the take-up of the dust and particles.

According to the Figures, it is recommended to have the second part 30*b* of the antihalo duct 30 open out inside the running channel 4 through the means 50 which define a direction substantially at right angles to the plane of the channel 4.

The means 50 can be designed so that the flow of ionised air establishes a movement in a converging direction in the direction of or in the opposite direction to the direction of movement, according to the arrow f1, of the strip product which is to be cleaned.

In order to evaluate the performance of the apparatus, various experiments have been conducted on the same strip of photographic product with a machine about midway of its lifetime. The orientation of the ducts 27 to pressurize the ionisation housing 20 was modified. The pressure inside the ionisation chamber was also modified. The various experiments are summarized in Table 1. After treatment the presence of dust was measured by accumulating the dust existing on a determined length of the strip by means of an adhesive transparent tape and then comparing the light energy transmitted by said tape before dust removal and after dust removal.

TABLE 1

| Ex | Curtain of air | Positive pressure in ionisation chamber | Ducts directed toward electrode tip | Emulsion face | Backing face |
|---|---|---|---|---|---|
| 1 | Yes | 0.5 bar | Yes | 1.46 | 12.9 |
| 2 | No | 3 bars | Yes | 1.42 | 14.1 |
| 3 | No | 3 bars | No | 1.47 | 13.1 |
| 4 | No | 0.5 bar | No | 1.52 | 13.4 |
| 5 | Yes | 0.5 bar | Yes | 1.46 | 12.6 |
| 6 | No | 0 bar | No | 2.97 | 13.5 |

From Table 1, it can be seen that the apparatus of the invention improves the cleaning of a photographic strip since Example 6 corresponds to the absence of cleaning operation and shows higher figures.

Examples 1 and 5 correspond to the preferred operation and demonstrate the stability of the cleaning operation.

Example 3 corresponds to the operation of a device similar to the one described in U.S. Pat. No. 3,409,768. The invention provides a slight improvement with less power consumption.

Example 4 demonstrates that the position of the ducts $27_1$ and $27_2$, as provided by the preferred embodiment of the invention improves the performance of the apparatus.

It was not possible to obtain data with the curtain flow of air and the high positive pressure in the ionisation chamber since channel 4 was not large enough and it would have caused damages to the photographic strip. A larger channel is possible but the efficiency of the ionisation process would have dropped.

The invention is not limited to the example described and shown, since various modifications can be made to it without departing from its scope.

I claim:

1. An apparatus for cleaning a strip of unexposed photosensitive product, including; a channel through which the strip can run in one direction of movement; a treatment area established transversely to the direction of running of the strip and over the entire width of the strip, the treatment area including means for sweeping both surfaces of the strip with a curtain of air flowing in the opposite direction to the strip; at least one elongated electrode having a tip and an axis, being connected to a high potential in order to produce local ionization by corona effect; an insulating housing defining a chamber wherein the electrode is enclosed, the housing being connected to said channel by an angled antihalo duct; and means for supplying compressed air to said chamber through at least one inlet duct in order to carry away ions from the electrode to the moving web through the antihalo duct, said at least one inlet duct being an elongated cylinder, the axis of which intercepts the axis of the electrode in the vicinity of its tip.

2. The apparatus according to claim 1, characterized in that the antihalo duct opens out into the channel upstream of the treatment area with respect to the direction of movement of the strip.

3. The apparatus according to claim 1, characterized in that the antihalo duct opens out into the running channel, in the treatment area which is delimited by suction chambers and sweeping means.

4. The apparatus according to claim 1, characterized in that the antihalo duct has, in the vicinity of the electrode, a first part in the shape of a converging cone channelling the flow of air towards a second part opening out into the channel.

5. The apparatus according to claim 1, characterized in that the flow of ionized air is maintained at a positive relative pressure inside the housing by at least one inlet duct.

6. The apparatus according to claim 1, characterized in that the housing is provided, in the area between the tip of the electrode and the first part of the antihalo duct, with a component which is electrically conductive and electrically insulated, forming, with the electrode, a capacitor defining the area in which the corona effect is produced.

7. The apparatus according to claim 6, characterized in that the electrically conductive and electrically insulated component is of the annular type and is disposed coaxially with the electrode.

8. The apparatus according to claim 1, characterized in that the means for supplying compressed air comprises means to induce a relative positive pressure of about 0.5 bar in said housing.

* * * * *